United States Patent [19]

Difflipp et al.

[11] Patent Number: 4,466,347

[45] Date of Patent: Aug. 21, 1984

[54] DEVICE FOR CONVEYING INK OR A DAMPING AGENT

[75] Inventors: Kurt Difflipp, Dietzenbach; Helmut Emrich, Offenbach am Main; Horst Erbach, Hofheim; Klaus Neberle, Heusenstamm; Heinrich Ochs, Oberzell; Günter Schwebe, Hainburg, all of Fed. Rep. of Germany

[73] Assignee: M.A.N. Roland Druckmaschinen Aktiengesellschaft, Fed. Rep. of Germany

[21] Appl. No.: 397,829

[22] Filed: Jul. 13, 1982

[30] Foreign Application Priority Data

Jul. 13, 1981 [DE] Fed. Rep. of Germany ..... 3127647

[51] Int. Cl.[3] ..... B01F 15/06

[52] U.S. Cl. ..... 101/148; 101/350; 101/DIG. 6

[58] Field of Search ..... 101/348–352, 101/141, 148, DIG. 6

[56] References Cited

U.S. PATENT DOCUMENTS

| | | | |
|---|---|---|---|
| 625,318 | 5/1899 | Bradford | 101/350 |
| 1,183,623 | 5/1916 | Blaine | 101/350 |
| 1,447,333 | 3/1923 | Bacon | 101/351 |
| 1,732,078 | 10/1929 | Black | 101/350 |
| 2,092,461 | 9/1937 | Luehrs . | |
| 2,474,160 | 6/1949 | Peyrebrune | 101/348 |
| 3,039,386 | 6/1962 | Trisler | 101/141 |

FOREIGN PATENT DOCUMENTS

| | | | |
|---|---|---|---|
| 2315391 | 1/1977 | France | 101/350 |

*Primary Examiner*—Edgar S. Burr
*Assistant Examiner*—John A. Weresh
*Attorney, Agent, or Firm*—Leydig, Voit, Osann, Mayer & Holt, Ltd.

[57] ABSTRACT

A fluid supply system for a lithographic printing press in which a fountain roller journalled in the frame of the press and driven at a slow speed is partially submerged so that a film of fluid is formed on its surface. A distributor roller is journalled in the frame parallel to the fountain roller and spaced therefrom to form a gap. A ductor roller movable broadwise in the gap is supported by a pair of arms which are, in turn, rigidly supported by a shaft journalled in the frame. A driving arm having a thrust rod connected thereto is rigidly secured to the shaft. The driving arm is coupled to a cam follower which engages a rotary cam so that upon rotation of the cam the shaft oscillates to swing the ductor roller back and forth for successive engagement of the fountain roller and the distributor roller to convey fluid therebetween. Opposed way surfaces are provided at the ends of the arms oriented generally perpendicular to the plane of the arms. Mounting blocks carrying the ends of the ductor roller are slidable on the way surfaces. Paired springs are provided on opposite sides of each of the mounting blocks in working opposition to one another so as to define a normal position of the ductor roller with respect to the arms. Upon engagement of the ductor roller with either the distributor roller or fountain roller, any relative overtravel of the cam follower is yieldingly accommodated by the deformation of the springs. A set screw in each arm prestresses the springs and adjusts the normal position of the ductor roller.

4 Claims, 3 Drawing Figures

DEVICE FOR CONVEYING INK OR A DAMPING AGENT

In printing presses of the lithographic type it is common to employ a ductor roller which is oscillated broadwise in the gap between the fountain roller and a distributor roller for conveying away a portion of the ink from the fountain roller. The ductor roller is mounted upon a pair of arms which may be oscillated back and forth by a cam follower riding in the groove of a rotary cam as disclosed, for example, in Luehrs U.S. Pat. No. 2,092,461. The stroke of the arms is adjustable by means of set screws so that the ductor roller is moved into touching engagement with the associated rollers at the high and low points of the cam. Such mechanism is quite expensive and difficult to adjust and to keep in adjustment. In addition the grooved cam must be tailor made for the application, and it is impossible, as a practical matter, to use the cam for ductor rollers of different diameter or for driving the ductor roller in the associated dampening system.

It is, accordingly, an object of the invention to provide means for oscillating a ductor roller in a printing press which operates with a high degree of reliability, which is non-critical in adjustment, which is easily and quickly adjusted, and which remains permanently in the adjusted condition. It is a related object to provide means for actuating a ductor roller in a printing press which does not require any critical relationship to exist between the diameter of the ductor roller and the cam which oscillates it and which is, therefore, usable with ductor rollers of differing diameter and cams of differing throw, provided only that the throw is great enough to achieve contact at each end of the ductor stroke.

It is another object to provide a mechanism for oscillating a ductor roller in a printing press which is simple and highly economical and which is capable of operating for long periods of time with only ordinary cleaning and lubrication.

It is still another object to provide a mechanism for oscillating a ductor roller in a printing press in which the ductor rollers in the inking and dampening systems may both be oscillated by a single rotary cam even though the inking and dampening ductors have different actuating stroke requirements.

It is an object of the invention in one of its aspects to provide a mechanism for oscillating the ductor roller in either an inking system or a dampening system in which a novel cushioning arrangement is provided insuring even contact along the length of the ductor roller and having provision for adjusting the amount of force which is brought to bear against the fountain roller and distributor roller, respectively. More specifically, it is an object to provide an oscillating mechanism for a ductor roller in which the ductor roller is floatingly mounted with respect to the supporting arms on adjustable springs and in which the adjusting means permits adjustment of pre-stress as well as adjustment of the nominal position of the ductor roller with respect to the supporting arms.

Other objects and advantages of the invention will become apparent upon reading the attached detailed description and upon reference to the drawings in which.

Figures 1, 2, 2A:
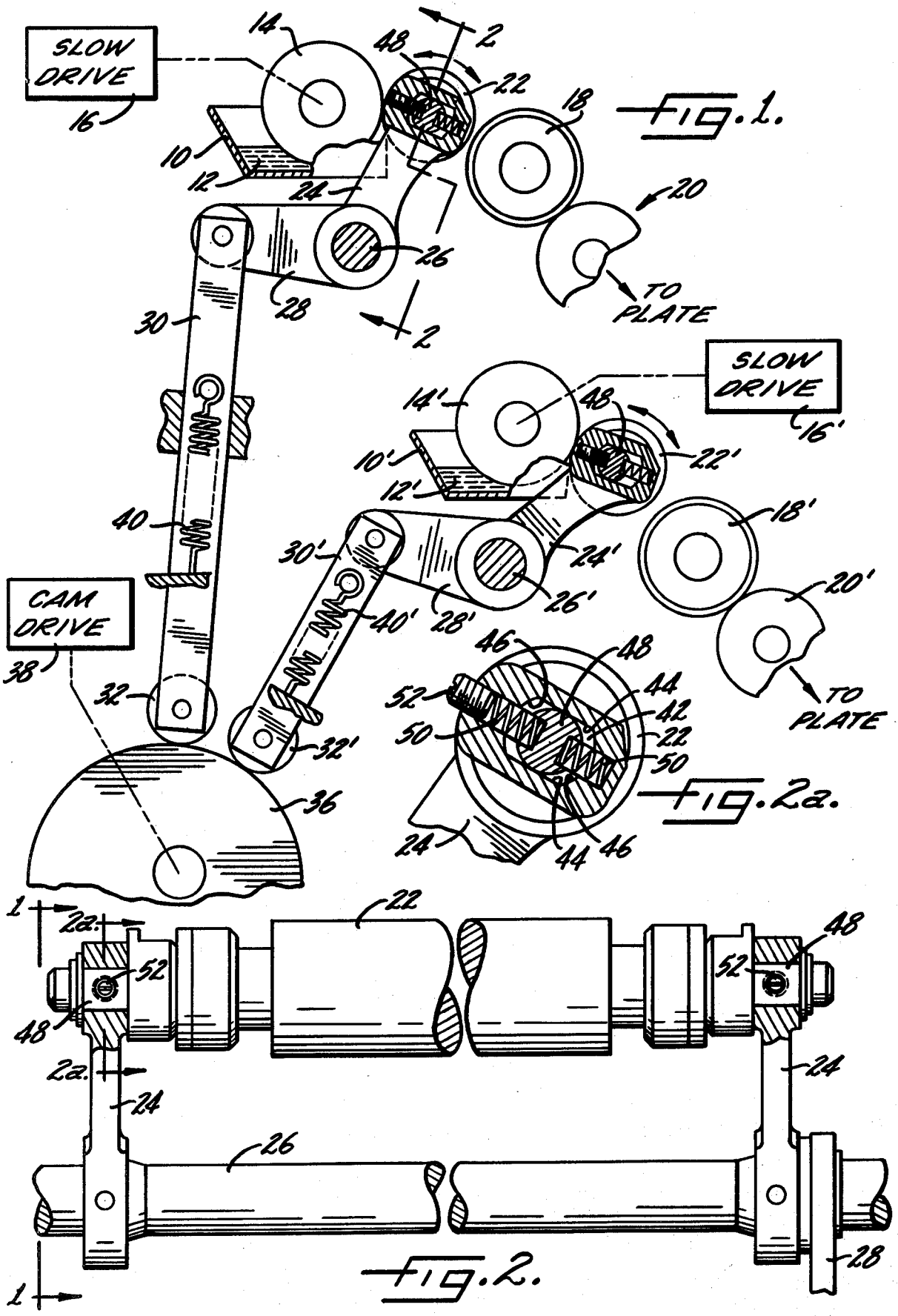
FIG. 1 is a end view looking along line 1—1 in FIG. 2 showing a fluid supply system embodying the present invention.
FIG. 2 is an enlarged view in partial section taken along line 2—2 in FIG. 1.
FIG. 2*a* is a fragmentary section taken along line 2*a*—2*a* of FIG. 2.

While the invention will be described in connection with a preferred embodiment, it will be understood that there is no intention to limit the invention to the construction shown. On the contrary, it is intended to cover the various alternative and equivalent constructions included within the spirit and scope of the appended claims.

Turning now to FIG. 1, there is shown a typical printing press having a trough 10, supported by a frame (not shown), for holding the ink supply 12 and a fountain roller 14 which is partially submerged in the ink supply so that upon rotation of the fountain roller by a slowly rotating driving means 16, the entire submerged length of the fountain roller will be coated with ink. A distributor roller 18 is journalled in the frame parallel to the fountain roller 14 and is spaced therefrom to form a gap. The distributor roller 18 is further mounted for rolling engagement with a series of rollers, indicated generally at 20, so that a film of ink on the distributor roller is eventually transferred to the printing plate.

A ductor roller 22 is movable broadwise through a short distance in the gap for engagement with the fountain roller 14 and the distributor roller 18 resulting in the conveyance of ink therebetween. The ductor roller 22 is supported on its ends by a pair of arms 24 rigidly supported by a shaft 26 journalled in the frame. A driving arm 28 is rigidly secured to the shaft 26.

To oscillate the ductor roller 22, a thrust rod 30 is provided which is connected on one end to the driving arm 28 and which carries a cam follower 32 on its other end. The cam follower 32 engages a rotary cam 36 having a cam drive 38. A helical spring 40 is interposed between the thrust rod 30 and the frame to maintain the cam follower 32 bottomed on the cam 36 throughout the rotation of the cam. Upon rotation of the cam 36, the thrust rod 30 and driving arm 28 oscillate the shaft 26 to swing the ductor roller 22 back and forth for successive engagement of the fountain roller 14 and the distributor roller 18 to convey ink therebetween.

In carrying out the present invention, means are provided on each arm 24 for guiding the ends of the ductor roller 22 for limited relative movement in a direction generally perpendicular to the plane of the arms. Springs are interposed between each ends of the ductor roller 22 and the arms 24 so that upon engagement of the ductor roller with either the fountain roller 14 or the distributor roller 18, any relative overtravel of the cam follower 32 is yieldingly accommodated by the deformation of the springs. Referring to FIGS. 2 and 2*a*, a window 42 is formed in the end of each arm having opposed parallel way surfaces 44 and end surfaces 46, the way surfaces being generally perpendicular to the plane of the arms. Mounting blocks 48 hold the ends of the ductor roller 22 and are snugly fitted for sliding movement on the way surfaces. Paired springs 50 are disposed within the window 42 on opposite sides of the mounting block 48 so as to abut the respective end surfaces 46. The mounting block and end surfaces have seats formed therein to maintain the springs in position. Each pair of springs is in working opposition so as to define a normal position of the ductor roller 22 with respect to the arms 24.

In practicing the invention, as the cam 36 is rotated by the cam drive 38, thrust rod 30 will be reciprocated to oscillate the ductor roller 22 so that it makes alternate contact with the fountain roller 14 and the distributor roller 18, the throw of cam 36 being greater than that needed to achieve contact at each end of the ductor roller stroke. When the ductor roller 22 is oscillated into contact with either a fountain roller 14 or the distributor roller 18, the mounting blocks 48 slide upon the way surfaces 44 to permit the entire length of the ductor roller to evenly contact the fountain roller and distributor roller. As the ductor roller is oscillated out of contact, the springs 50 return the mounting blocks 48 to normal position within the window.

In keeping with the invention, means are provided for variably prestressing the springs 50 to determine the normal position of the ductor roller with respect to the arms and the amount of force which is exerted between the rollers upon engagement thereof. Thus, a set screw 52 is provided in each arm, the screw being in axial alignment with one of the springs 50. To adjust the normal position of the ductor roller and the load on the springs, the thrust rod 30 is moved to the highest point of the cam 36 so that the arms 24 reach their end position. The position of mounting blocks 48 within their respective windows 42 is then adjusted by set screws 52 so that the entire length of the ductor roller 22 closely abuts against the distributor roller 18. When the ductor roller 22 oscillates to abut the fountain roller 14, the mounting blocks 48 slide within the windows 42 against the force of the springs 50. The ductor roller 22 does not have to be adjusted relative to the fountain roller 14 as long as there is accommodation in the springs to allow the mounting blocks to slide upon contact of the ductor roller with the fountain roller. If desired separate set screws may be provided for each one of the opposed springs.

Also in keeping with the present invention, since the size of cam is not critical as long as its throw is sufficient to achieve contact at each end of the ductor roller stroke, a single cam can drive both an ink ductor roller and a water ductor roller. Referring to FIG. 1, in which components of the dampening system similar to those of the inking system are marked with a prime, a water fountain 10' includes a fountain roller 14' journalled in the frame and driven at a slow speed by drive means 16' so that a film of water is formed on the surface of the fountain roller. A water distributor roller 18' is journalled in the frame parallel to the fountain roller 14' and spaced therefrom to form a gap. A water ductor roller 22' is movable broadwise through a short distance in the gap, and means including a cam follower 32' are provided for swinging the water ductor roller 22' back and forth for successive engagement of the water fountain roller 14' and the water distributor roller 18'. The rotary cam 36, which drives both the inking system and the dampening system, may be sized to (a) either overdrive both the ink ductor roller and the water ductor roller, or (b) may be sized to overdrive one and not the other. In either case, the overdriven ductor roller shall include a yieldable spring effectively interposed between it and its associated cam follower so that upon engagement of such roller at the limits of movement in the gap any relative overtravel of the associated cam follower is yieldingly accommodated by the deformation of the spring. Thus, by judiciously selecting the size of the rotary cam so that it overdrives at least one of the ductor rollers, the same cam can be used to drive other ductor rollers in the press regardless of any differences in the size of the gap between the fountain rollers and distributor rollers or in the diameter of the ductor rollers.

Thus, it will be apparent that the objects of the invention have been amply fulfilled. By interposing a yieldable spring between the ductor roller and the cam follower, automatic adjustment of the ductor roller to fully contact either the fountain roller or the distributor roller has been accomplished. Further, the size of the rotary cam has been made non-critical, thus permitting a single cam to drive more than one ductor roller. The term "thrust rod" as used herein shall be understood to mean any motion transmitting element interposed between the cam follower and the arm which osillates the shaft 26. The term "relative overtravel of the follower" means motion of the cam follower, due to the throw of the cam, which is greater than that required to move the associated ductor roller broadwise between its limit positions in the gap.

We claim:

1. In a fluid supply system for a printing press, the combination comprising a frame, a fountain including a fountain roller journalled in the frame and driven at slow speed so that a film of fluid is formed on its surface, a distributor roller journalled in said frame parallel to the fountain roller and spaced therefrom to form a gap, a ductor roller movable broadwise through a short distance in the gap, a pair of arms for supporting the ends of the ductor roller, a shaft journalled in the frame for rigidly supporting the arms, a driving arm rigidly secured to the shaft, a thrust rod having one end pivotally connected to the driving arm and the other end carrying a cam follower, a rotary cam and means for driving said cam means directly connected to both said frame and said thrust rod for maintaining the cam follower in contact with the cam so that upon rotation of the cam the shaft oscillates to swing the ductor roller back and forth for successive engagement of the fountain roller and the distributor roller resulting in conveyance of fluid therebetween, means defining opposed way surfaces at the ends of the arms oriented generally perpendicularly to the plane of the arms, mounting blocks at the ends of the ductor roller snugly slidable on the way surfaces, the cam having sufficient throw to produce relative overtravel of the cam follower, and paired springs on the respectively opposite sides of each of the mounting blocks and working in opposition to one another to define a normal position of the ductor roller with respect to the arms on which it is mounted and so that upon engagement of the rollers the relative overtravel is yieldingly accommodated by the deformation of the springs.

2. The combination as claimed in claim 1 in which each arm has a window formed at the end thereof defining parallel way surfaces and end surfaces, the parallel way surfaces being generally perpendicular to the plane of the arms, mounting blocks at the respective ends of the ductor roller fitted for sliding movement on the way surfaces, the springs being interposed between the end surfaces and the mounting block.

3. The combination as claimed in claim 1 in which means are provided for variably prestressing the springs to determine the normal position of the ductor roller with respect to the arms and the amount of force which is exerted between the rollers upon engagement thereof.

4. The combination as claimed in claim 1 in which at least one of the springs working in opposition at each end of the ductor roller is provided with a set screw for adjusting the normal position of the ductor roller with respect to the arms as well as the degree of preload of the springs.

* * * * *